United States Patent [19]

Riedel

[11] 4,181,321

[45] * Jan. 1, 1980

[54] COMBINED SKI BRAKE AND FASTENING DEVICE

[75] Inventor: Tilo Riedel, Eching, Fed. Rep. of Germany

[73] Assignee: S.A. Etablissements, Annecy, France

[ * ] Notice: The portion of the term of this patent subsequent to Jun. 22, 1993, has been disclaimed.

[21] Appl. No.: 859,932

[22] Filed: Dec. 12, 1977

Related U.S. Application Data

[63] Continuation-in-part of Ser. No. 665,373, May 10, 1976, Pat. No. 4,062,553, which is a continuation-in-part of Ser. No. 557,476, Mar. 12, 1975, Pat. No. 3,989,271.

[30] Foreign Application Priority Data

| | | | |
|---|---|---|---|
| Mar. 15, 1974 | [DE] | Fed. Rep. of Germany | 2412263 |
| Jul. 26, 1974 | [DE] | Fed. Rep. of Germany | 2436155 |
| Feb. 2, 1975 | [DE] | Fed. Rep. of Germany | 2507371 |

[51] Int. Cl.[2] ..... A63C 7/10

[52] U.S. Cl. ..... 280/605; 280/11.37 A

[58] Field of Search ..... 280/605, 604, 633, 11.37 K, 280/11.37 A; 188/5

[56] References Cited

U.S. PATENT DOCUMENTS

| | | | |
|---|---|---|---|
| 4,062,553 | 12/1977 | Riedel | 280/605 |
| 4,078,824 | 3/1978 | Riedel | 280/605 |

FOREIGN PATENT DOCUMENTS

| | | | |
|---|---|---|---|
| 2412623 | 11/1975 | Fed. Rep. of Germany | 280/605 |
| 2502067 | 7/1976 | Fed. Rep. of Germany | 280/605 |
| 626723 | 10/1961 | Italy | 280/605 |
| 224227 | 11/1942 | Switzerland . | |

*Primary Examiner*—David M. Mitchell

*Attorney, Agent, or Firm*—Karl F. Ross

[57] ABSTRACT

A pair of skis are provided on their upper surfaces with respective mounting plates each carrying a treadle depressible by the boot of the user, the treadle overlying the bight of a yoke biased into a rising position be a pair of inclined shanks traversing the mounting plate. The extremities of the wire yoke carry blade-shaped brake elements which in the absence of boot pressure project downwardly beyond the runner surface of the ski and have confronting inner edges formed with notches coming to lie at the level of that surface, the width of the notch exceeding the thickness of the blade whereby the outer blade edges of the other ski can be received in these notches to hold the two skis together in back-to-back position with their runner surfaces contacting each other.

14 Claims, 2 Drawing Figures

COMBINED SKI BRAKE AND FASTENING DEVICE

CROSS-REFERENCE TO RELATED APPLICATIONS

This is a continuation-in-part of my copending application Ser. No. 665,373, now U.S. Pat. No. 4,062,553, filed May 10, 1976 as a continuation-in-part of my earlier application Ser. No. 557,476 filed Mar. 12, 1975, now U.S. Pat. No. 3,989,271.

FIELD OF THE INVENTION

My present invention relates to a ski brake also serving as a fastening device for temporarily holding a pair of skis together in back-to-back relationship, i.e. with their runner surfaces in contact.

BACKGROUND OF THE INVENTION

The usual devices for securing a pair of skis to each other for transportation and storage include leather straps and clips of various shapes. Since they must be carried apart from the skis when the latter are in use, they tend to get lost and often cannot be replaced until the user returns from the ski trip.

OBJECTS OF THE INVENTION

The general object of my present invention, therefore, is to provide an improved fastening device obviating this drawback.

A more particular object is to provide a fastening device of this type which also serves as a ski brake.

SUMMARY OF THE INVENTION

In my above-identified applications and patents I have disclosed a brake to be permanently mounted on a ski in order to arrest same when the ski is accidentally detached from the boot of the user. The brake, which is pivotally mounted on the top surface of the ski for swinging about a generally transverse axis, includes a pair of blades straddling the ski and an actuating member above that surface depressible by the user's boot for retracting the blades above the level of the runner surface or underside of the ski against a biasing force which tends to swing them into a forwardly and downwardly inclined position. Each blade has an inner edge formed with a notch which in its extended position, as particularly set forth in application Ser. No. 665,373, can receive a longitudinal edge of the opposite ski or of the brake thereof. It is this latter feature which will be more fully described hereinafter.

Thus, pursuant to my present invention, each blade of at least one ski of a pair has an inner edge formed with a transverse shoulder facing the pivotal axis thereof, this shoulder being engageable by an outer edge of a respective blade of the other ski to facilitate the temporary interconnection of the two skis by an interlocking of their brakes. In the extended blade position, i.e. in the absence of boot pressure on the actuating member, the shoulders come to lie substantially at the level of the runner surface which allows the interconnected skis to be brought into full contact with each other. The actuating member is advantageously the bight of a resilient wire yoke with shanks engaging a mounting plate and with extremeties sheathed by the blades.

According to a more particular feature of my invention, the shoulders are formed by notches in the inner blade edges having a width greater than the thickness of the coacting outer brake edges.

BRIEF DESCRIPTION OF THE DRAWING

The above and other features of my invention will now be described in detail with reference to the accompanying drawing in which.

SPECIFIC DESCRIPTION

Figure 1:
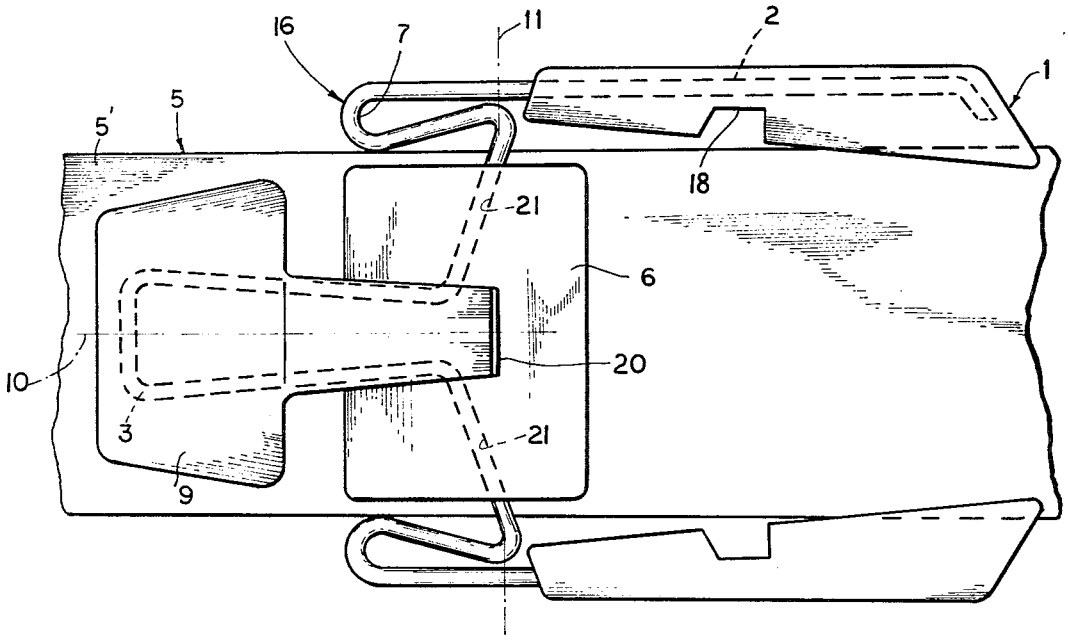
FIG. 1 is a fragmentary top view, partly in diagrammatic form, of a central portion of a ski provided with a combined brake and fastening device according to my invention.

In FIG. 1 I have shown a ski 5 whose upper surface 5' carries a mounting plate 6 having a central cutout 20 and a pair of slanting bores 21, the latter being transversed by shanks 4 of a yoke or stirrup 16 of resilient wire. The yoke has a bight 3 which normally rises from cutout 20 under its inherent elastic force and which is overlain by a treadle 9 swingably seated in that cutout. Yoke 16, mounting plate 6 and treadle 9 are symmetrical about the longitudinal centerline 10 of the ski 5.

Figure 2:
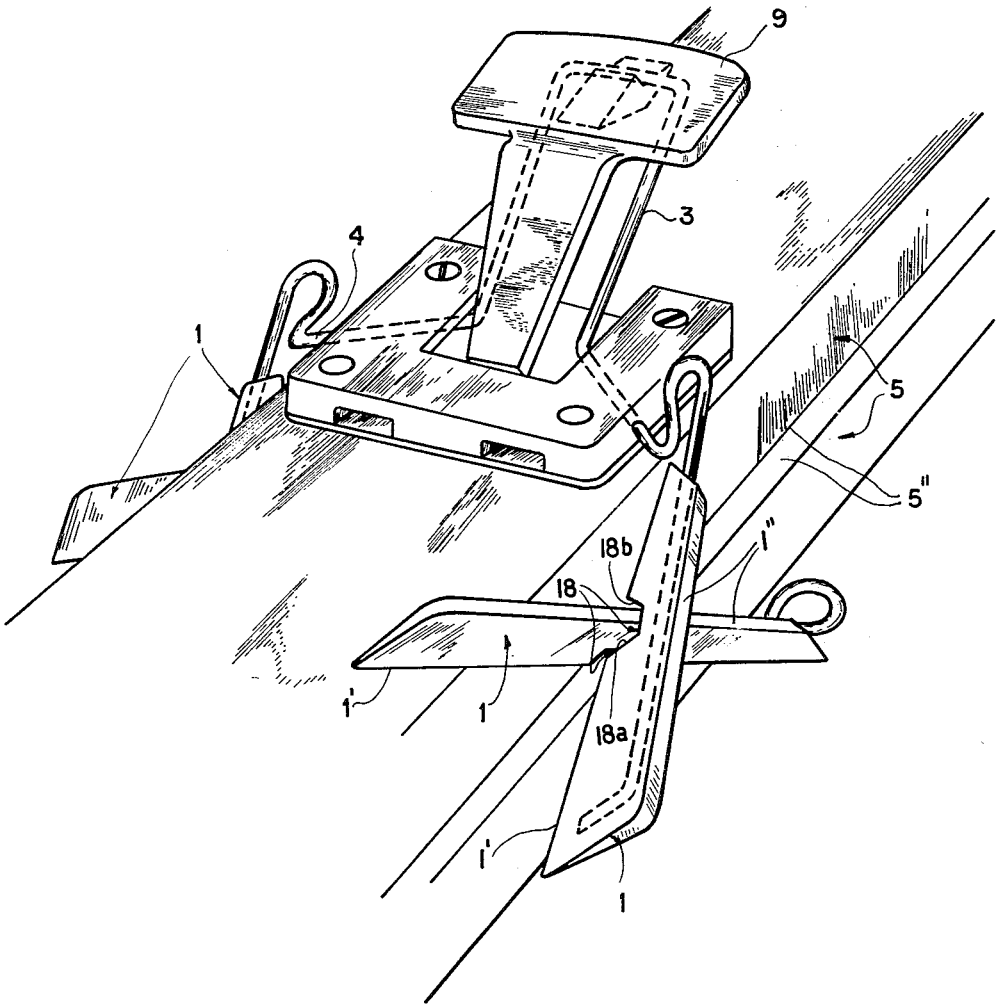
FIG. 2 is a perspective view of the midsections of a pair of skis with interengaging brakes of the type shown in FIG. 1.

Each yoke extremity 2 is sheathed in a blade-shaped brake element 1 of generally trapezoidal configuration which in the normal position shown in FIG. 2, i.e. when no boot presses on treadle 9, extends forwardly and downwardly past the undersurface 5'' of ski 5 so as to bite into the snow and arrest the ski to prevent the latter in its unloaded state from running wild and endangering persons or property. An inner edge 1' of each blade 1 has a notch 18 which in this position lies substantially at the level of runner surface 5'' and whose width exceeds the thickness of the blade at its outer edge 1'', thus allowing the brakes of two skis placed back-to-back to interengage for holding the skis together with one brake embracing the other as shown in FIG. 2. This Figure also shows that the blades have a wedge-shaped profile converging toward the inner edge 1'. In order to facilitate the spreading of the yoke of the embracing brake, the extremities 2 may be connected with the associated shanks 4 by way of resiliency-increasing formations such as wire loops 7 as illustrated. Reference is made to my above-identified applications and patents for a disclosure of other formations of this type.

When the heel of a boot bears down upon treadle 9, the extended brake is retracted above the level of top surface 5' to let the tips of the blades overlie that surface as the yoke 16 is swung into a substantially horizontal position against the biasing force provided by the forwardly diverging spring-wire shanks 4. Such a biasing force could also be furnished by an external spring, or by cams coacting with the legs of bight 3 as disclosed in my prior U.S. Pat. No. 3,989,271 and in my copending application Ser. No. 665,515 filed May 10, 1976; in that instance the shanks 4 could be in line with each other and perpendicular to the longitudinal dimension of the ski.

If no gripping of one ski by the notched blades of the other ski is contemplated, the width of the notches 18 may be substantially less than the height of the ski 5, as illustrated. The trapezoidal shape of the notch facilitates the interfitting of the blades in the position shown in FIG. 2 in which they include an obtuse angle with each other.

Obviously, the blades of only one brake of a pair of skis needs to be notched for the described mode of interengagement. For the sake of mass production and interchangeability, however, it will generally be desirable to have the two brakes identically shaped.

The notches 18 have transverse shoulders 18*a* which face the individual pivotal axes 11 of the blades, defined by their shanks 4, and are instrumental in locking the skis together. The opposite, inclined boundaries 18*b* of the notches merely prevent the blades from flexing out of interengagement and might therefore not be needed if the blades are otherwise prevented from swinging beyond the position of FIG. 2.

I claim;

1. In a pair of skis each having a runner surface, a top surface and a brake attached to said top surface by pivotal mounting means for swinging about a generally horizontal axis, said brake including a pair of laterally resiliently displaceable blades which straddle the ski and are displaceable between a retracted position above the level of said runner surface and a downwardly inclined position.

the improvement wherein each of said blades of one of said skis has an inner edge formed with a substantially transverse shoulder facing said axis, said shoulders being engageable by respective outer blade edges of the other of said skis with outward resilient displacement of the blades of said one ski and inward resilient displacement of the blades of said other ski for locking said skis together upon a positioning thereof back-to-back with their runner surfaces contacting each other.

2. The improvement defined in claim 1 wherein said shoulders lie substantially at the level of said runner surface in said downwardly inclined position.

3. The improvement defined in claim 1 wherein said axis is generally perpendicular to the longitudinal direction of the respective ski, said blades pointing forwardly in said downwardly inclined position.

4. The improvement defined in claim 3 wherein said shoulders are formed by notches of said inner edges, said outer blade edges having a thickness less than the width of said notches.

5. The improvement defined in claim 4, further comprising an actuating member above said top surface depressible by the boot of a user for retracting said blades.

6. The improvement defined in claim 5 wherein said notches are positioned to lie substantially at the level of said runner surface in the absence of boot pressure on said actuating member.

7. The improvement defined in claim 6 wherein said brake comprises a resilient wire yoke with a bight constituting said actuating member and extremities sheathed by said blades.

8. The improvement defined in claim 7, further comprising a mounting plate on said top surface and a treadle on said mounting plate overlying said bight, said wire yoke having a pair of shanks engaging said mounting plate.

9. The improvement defined in claim 8 wherein said mounting plate has a central cutout and a pair of lateral bores traversed by said shanks, said bight and said treadle being lodged in said cutout.

10. The improvement defined in claim 9 wherein said bores are inclined with reference to said axis, said shanks diverging forwardly in a direction away from said bight.

11. The improvement defined in claim 9 wherein said wire yoke is provided with resiliency-increasing formations between said shanks and said extremities.

12. The improvement defined in claim 7 wherein said notches are formed in said sheathed extremities.

13. The improvement defined in claim 4 wherein said notches have a trapezoidal outline.

14. The improvement defined in claim 1 wherein the blades of both skis are provided with said shoulders.

* * * * *

UNITED STATES PATENT AND TRADEMARK OFFICE

CERTIFICATE OF CORRECTION

PATENT NO. : 4,181,321

DATED : 1 January 1980

INVENTOR(S) : Tilo Riedel

It is certified that error appears in the above-identified patent and that said Letters Patent are hereby corrected as shown below:

Please correct the Assignee in [73] to read:

-- S. A. Etablissements François Salomon & Fils --.

Signed and Sealed this

*Twenty-fifth* Day of *March 1980*

[SEAL]

*Attest:*

SIDNEY A. DIAMOND

*Attesting Officer*

*Commissioner of Patents and Trademarks*

Disclaimer 4,181,321.—*Tilo Riedel,* Eching Germany. COMBINED SKI BRAKE AND FASTENING DEVICE. Patent dated Jan. 1, 1980. Disclaimer filed Mar. 2, 1981, by the assignee, *S. A. Etablissements Francois Salomon & Fils.*

The term of this patent subsequent to June 22, 1993, has been disclaimed.

[*Official Gazette April 7, 1981.*]